United States Patent [19]

Frommeld

[11] 4,171,222

[45] Oct. 16, 1979

[54] TWO-COMPONENT DIAZOTYPE MATERIAL

[75] Inventor: Hans-Dieter Frommeld, Wiesbaden, Fed. Rep. of Germany

[73] Assignee: Hoechst Aktiengesellschaft, Fed. Rep. of Germany

[21] Appl. No.: 853,519

[22] Filed: Nov. 21, 1977

[30] Foreign Application Priority Data

Nov. 22, 1976 [DE] Fed. Rep. of Germany ..... 2652942

[51] Int. Cl.[2] ..... G03C 1/52

[52] U.S. Cl. ..... 96/75; 96/91 R

[58] Field of Search ..... 96/91 R, 75, 49

[56] References Cited

U.S. PATENT DOCUMENTS

| | | | |
|---|---|---|---|
| 2,990,281 | 6/1961 | Printy et al. | 96/91 R |
| 3,316,092 | 4/1967 | Klimkowski et al. | 96/91 R |
| 3,679,421 | 7/1972 | Kasper | 96/91 R |
| 3,884,693 | 5/1975 | Bauer et al. | 96/91 R |

*Primary Examiner*—Won H. Louie, Jr.

*Attorney, Agent, or Firm*—James E. Bryan

[57] ABSTRACT

This invention relates to an improvement in a two-component diazotype material comprising a film support and a light-sensitive layer thereon, the light-sensitive layer being composed of at least one polymeric hydrophobic binder, a light-sensitive diazonium salt and a coupler, the improvement that the light-sensitive layer additionally contains at least one resin containing acid groups, which resin has an acid number of at least about 100 and which is derived from the maleic acid or phthalic acid type.

5 Claims, No Drawings

TWO-COMPONENT DIAZOTYPE MATERIAL

The present invention relates to a two-component diazotype material comprising a film support and a light-sensitive layer applied to the support, the light-sensitive layer being composed of at least one polymeric hydrophobic binder, a light-sensitive diazonium salt and a coupler.

As is known, two-component diazotype materials are capable not only of being developed with ammonia, but also by an application of alkaline reacting solutions (J. Kosar, "Light-Sensitive Systems", John Wiley and Sons Inc., New York (1965), page 252). The compounds having an alkaline reaction when dissolved may be inorganic substances (e.g. potassium hydroxide—cf. German Offenlegungsschrift No. 1,597,631), and also organic substances (e.g. cyclohexyl amine—cf. German Auslegeschrift No. 1,522,449). In German Pat. No. 889,548, it is disclosed that hydrophobic diazotype layers also may be developed with aqueous solutions of aliphatic bases.

In most cases, however, in particular when developing with aqueous solutions, the developing speed is not satisfactory at ambient temperature. Therefore, it already has been attempted to increase the speed by adding organic solvents to the aqueous developer. This, however, has the serious disadvantage that the resulting dyes of the lines are washed out. Another possibility of accelerating the developing speed is to increase the temperature of the developing agent. This means, however, that the developing tanks must be heated and, in extreme cases, they even must be equipped with thermostats.

Apart from these possibilities of increasing the developing speed, it is also known to modify the light-sensitive layer, in order to obtain an accelerated wet development. In German Offenlegungsschriften Nos. 2,041,665, and 2,441,985, it is recommended to add so-called "plasticizers", i.e. high-boiling monomeric substances to the binder, e.g. phthalic acid dimethyl ester or glycerol triacetate. However, when these plasticizers are used, it is a disadvantage that already in the developing process part of the dye is dissolved out of the layer, thus impairing the optimum optical density. In addition, the light-sensitive layers to which plasticizers are added do not have a sufficient hardness; they are, therefore, of reduced mechanical resistance and become sticky when heated.

It is also known [C.A. 83,138944 K (1975)] to prepare films for wet development as follows: A hydrophobic film of a synthetic resin serving as a support is treated with a solution of a hydrophilic resin in an organic solvent which causes the support to swell; in an ensuing step a conventional light-sensitive layer is applied to the surface. This method has the disadvantage that the hydrophilic polymers are fixed solely at the boundary region of the layer and that the light-sensitive layer is applied in a subsequent operating step only. It is further a disadvantage that the high concentration of the hydrophilic resin in the boundary layer results in surfaces which tend to be tacky and are thus useless.

It is, therefore, an object of the invention to specify substances which accelerate development in a light-sensitive layer containing diazonium salts, without adversely affecting the quality of the diazotype films, as well as their mechanical properties, e.g., strength and softening at temperatures ranging between 70° and 100°

C., their optical properties, e.g., transparency of the non-image areas, and their storability, e.g., absence of coupling into dyes when stored.

This problem is solved by a two-component diazotype material comprising a film support and a light-sensitive layer applied to the support, which light-sensitive layer is composed of at least one polymeric hydrophobic binder, a light-sensitive diazonium salt, and a coupler. The light-sensitive layer additionally contains at least one resin containing acid groups, which resin has an acid number of at least about 100 and is derived from the maleic acid or phthalic acid type.

In a preferred embodiment, the resin containing acid groups has an acid number of at least 200.

In this way, an acceleration of development is achieved in spite of an increase of the acid components in the light-sensitive layer.

It has been found that the resin containing acid groups clearly accelerates development when used in a concentration of about 5 to 30 percent by weight, relative to the hydrophobic binder employed. This was not to be expected, because it is known that acids are used to stabilize two-component layers and that the speed of development decreases with an increasing acid concentration, because a higher amount of alkali is necessary for neutralization.

As was to be expected, the substances according to the invention also cause an improvement of storability. They prevent a premature coupling and thus improve the clarity of the non-image areas. At present, it is impossible to give an explanation for the accelerated coupling which is observed independent of the hydrophilic properties of the resins containing acid groups.

It is a great advantage of the invention that, for one and the same developer, either development is accelerated or, in case of an already sufficient developing speed, it is possible to make the developer less aggressive, i.e. to apply it in a more highly diluted form, when the inventive resin containing acid groups is used.

According to the invention, copolymers of maleic anhydride with styrene, ethylene or alkyl vinyl ethers, e.g. with methyl vinyl ethers, are used as the resins containing acid groups. These resins are, e.g. known by the trade names of Lytron® or Ema® of Monsanto Co., U.S.A., or by the name of Gantrez® of GAF Corp., U.S.A. The maleic anhydride groups may be converted, e.g., saponified by dissolving in water or half esterified by dissolving in alcohols, such as methanol, butanol or glycol monoethyl ether.

The compolymers of maleic anhydride are particularly advantageous when maximum requirements must be met in view of the transparency of the material.

Colophony maleic resins are also suitable, which are commercially available by the name of Alresat® of HOECHST AG.

Further, acid alkyd resins based on phthalic anhydride which are marketed by the name of Alftalat® of HOECHST AG or by the name of Phtalopal® of BASF are useful as resins containing acid groups.

These resins produce a satisfactory acceleration of development and, at the same time, an excellent improvement of storability.

As supports, films of synthetic materials, e.g., of polyester or polycarbonate, or films based on cellulose esters may be used, and also glass plates, quartz plates or films having a metallized surface. Supports composed of polyethylene terephthalate are particularly preferred.

Conventional polyvinyl compounds, e.g., polyvinyl acetate or polyvinyl butyrate; or copolymers of vinyl chloride, vinyl acetate, acrylic or methacrylic acid esters are used as hydrophobic binders. Due to their good film-forming properties cellulose esters, such as cellulose acetate, cellulose triacetate, cellulose aceto propionate, cellulose aceto butyrate, cellulose propionate and cellulose butyrate have proved particularly suitable.

Accordingly, a mixture of a hydrophobic binder, such as a cellulose ester, and a copolymer of maleic anhydride is preferred according to the invention.

The diazonium compounds which may be used for the preparation of the light-sensitive layers are any of the great number of known diazonium salts available. Exemplary are the diazonium salts derived from substituted p-phenylene diamine or p-mercapto aniline, e.g.,

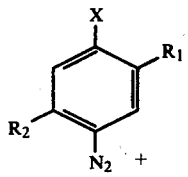

in which $R_1$ and/or $R_2$ may be hydrogen, chlorine, a methyl, methoxy, ethoxy or butoxy group, and X may be a dimethyl amino, diethyl amino, dipropyl amino, morpholino, pyrrolidino, piperidino, alkyl mercapto or tolyl mercapto group.

The diazonium salt is in a stabilized form, as known, as a zinc chloride double salt, a cadmium chloride double salt, a tin chloride double salt, a boron fluoride salt, a sulfate salt, a hexafluoro phosphate salt, or the like.

The types of couplers to be used are also known. They are selected in accordance with the desired shade of the lines. Exemplary are couplers based on cyano acetic acid amide, acetoacetic acid amide, a phenol, and phenol carboxylic acid amide, a naphthol, and naphthol carboxylic acid amide, resorcinol, and resorcylic acid derivatives or couplers based on mono, di, tri and tetrahydroxy-diphenylene or triphenylene, which also may be substituted.

The photocopying layer also may contain the conventional stabilizers, e.g., 5-sulfosalicylic acid, citric acid, maleic acid, tartaric acid, boric acid, and thiourea.

The light-sensitive layer may also contain pigments, e.g., a colloidal precipitated silicic acid, a finely ground aluminum oxide or silicates.

For the preparation of the developing solutions substances may be used which, in an aqueous solution, have an alkaline reaction, e.g. alkali hydroxides or alkali metal salts of weak acids, such as sodium carbonate, borates of potassium, phosphates or silicates or organic amines; the non-odorous ecologically acceptable amines being preferred, e.g., ethanolamine or amino propanol, diethanolamine and triethanolamine, ethylene diamine or propylene diamine, amino pyridine, imidazole or methyl or dimethyl imidazole.

Water is preferred as a solvent, but it is also possible to add certain amounts of organic solvents to the water. It is advantageous to add an alkali-resistant wetting agent which may be selected from one of the groups of the anionic, nonionic or cationic wetting agents. Further, the developer may contain salts, such as sodium sulfate, sodium chloride or potassium acetate.

The invention will be further illustrated by reference to the following specific examples:

EXAMPLE 1

3.5 g—of cellulose aceto propionate (Cellit ® PR 700 of BAYER AG),
0.13 g—of 5-sulfosalicylic acid,
0.7 g—of diresorcyl sulfide, and
0.7 g—of 4-morpholino-2,5-dibutoxy-benzene diazonium tetrafluoro borate, are successively dissolved in 34 ml of acetone,
6 ml of methanol, and 6 ml of methyl glycol, and then in one mixture each:

A—0.4 g of an alkyd resin having an acid number of 180 to 210, which is 67 percent by weight composed of phthalic acid (Alftalat AN 420 of HOECHST AG), B—0.4 g of a polymer of methyl vinyl ether and maleic anhydride, a 5 percent aqueous solution of which at pH 2 has a viscosity of 5±2 cP (Viscofas ® L 5 of ICI Ltd.), C—0.4 g of a poly(methyl vinyl ether/maleic anhydride) having a viscosity of 13 cP in a 5 percent aqueous solution at pH 2 (Gantrez AN 119 of GAF Corp., U.S.A.)

is dissolved. A mixture D is used without any addition.

The light-sensitive lacquer solutions having a wet weight of about 100 ml/m$^2$≈80 g/m$^2$ are cast on a polyester film pretreated with $SiO_2$/trichloro acetic acid and are then dried. In order to determine the developing speed, strips of the corresponding light-sensitive materials are immersed in a bowl containing a developer I of the following composition:

15 percent by weight of ethanolamine,
0.5 percent by weight of alkyl phenol polyglycol ether (Arkopal ® N 100 of HOECHST AG), and
84.5 percent of water.

For different strips development is stopped after 0.5, 1, 2 or 5 minutes by removing the strips from the developer and dipping them into water.

Subsequently, the residual diazo is destroyed by post-exposure and the density obtained is measured by means of a Macbeth-Quanta-Log-Densitometer TD 205 using a Schott-UG4 filter. The density values determined are listed in the table below:

| | Developing Time (minutes) | | | |
|---|---|---|---|---|
| Sample | 0.5 | 1 | 2 | 5 |
| A | 0.84 | 1.73 | 1.73 | 1.75 |
| B | 1.54 | 1.75 | 1.74 | 1.73 |
| C | 1.60 | 1.70 | 1.72 | 1.73 |
| D | 0.40 | 0.55 | 0.83 | 1.55 |

When a developer II is used instead of the developer I a similar result is obtained, as can be seen from the following table:

(Composition of developer II:
97.5 percent by weight of water,
0.5 percent by weight of an olefin sulfonate (Hostapur ® OS of HOECHST AG), and
2.0 percent of NaOH).

| | Developing Time (minutes) | | | | |
|---|---|---|---|---|---|
| Sample | 0.5 | 1 | 2 | 5 | $NH_3$ |
| A | 0.65 | 0.88 | 1.32 | 1.70 | 1.71 |
| B | 0.99 | 1.42 | 1.73 | 1.73 | 1.70 |

-continued

| Sample | Developing Time (minutes) 0.5 | 1 | 2 | 5 | $NH_3$ |
|---|---|---|---|---|---|
| C | 1.00 | 1.35 | 1.72 | 1.72 | 1.74 |
| D | 0.34 | 0.49 | 0.79 | 1.51 | 1.73 |

The last column shows the densities obtainable in case of development with ammonia in a photocopying machine (developing temperature 80° C).

EXAMPLE 2

0.4 g of a poly(methyl vinyl ether/maleic anhydride) in accordance with Example 1 C is heated during a period of 5 hours to 100° C. in 5 ml of n-butanol until completely dissolved. Then the solution is left standing for 20 hours at 25° C., and the following components are successively added:

18 ml of acetone,
2.0 g of cellulose aceto propionate,
0.1 g of 5-sulfosalicylic acid,
0.3 g of 2,2-bis-(4-hydroxyphenyl)-propane,
0.1 g of 1-(7'-hydroxynaphthyl)-2,4-diiminotetrahydro-1,3,5-triazine-formate, and
0.55 g of 4-p-tolyl mercapto-2,5-diethoxy-benzene diazonium tetrafluoro borate.

As a reference solution for this solution called "A" a solution "B" is prepared which contains the same components, with the exception of the poly(methyl vinyl ether/maleic anhydride).

In accordance with Example 1, the solutions are cast onto a polyester film with improved adhesion; they are then dried and treated with the developer I as in Example 1, in order to determine the developing speed.

| Sample | Developing Time (minutes) 1 | 3 | 6 | $NH_3$ |
|---|---|---|---|---|
| A | 1.16 | 2.10 | 2.67 | 2.70 |
| B | 0.28 | 0.31 | 0.37 | 2.70 |

EXAMPLE 3

A lacquer solution composed of 5.4 g of cellulose aceto propionate,
51 ml of acetone,
12 ml of methanol,
8 ml of methyl glycol,
0.3 g of sulfosalicyclic acid,
1.05 g of diresorcyl sulfide, and
1.05 g of 4-pyrrolidino-3-methyl-benzene diazonium chloride as a zinc chloride double salt is divided into three parts and to part A—0.2 g of a poly(methyl vinyl ether/maleic anhydride), to part B—0.2 g of a styrene-maleic anhydride copolymer, having a molecular weight of 50,000 and an acid number of 320 (Lytron® 810 of Monsanto Co., U.S.A.)

is added.

Part C is used without addition.

A polyethylene terephthalate film is coated with this lacquer, as in Example 1, and after drying the film is developed using the developer I.

| Sample | Developing Time (minutes) 1 | 3 | $NH_3$ |
|---|---|---|---|
| A | 1.40 | 2.20 | 2.20 |
| B | 1.20 | 2.30 | 2.30 |
| C | 0.80 | 1.10 | 2.30 |

EXAMPLE 4

The same procedure is used as in Example 3, with the exception that 1.05 g of 4-N-ethyl-N-benzyl amino-benzene diazonium chloride as a zinc chloride double salt are added instead of 1.05 g of 4-pyrrolidino-3-methyl-benzene diazonium salt.

After wet development for 1 or 3 minutes, using the developer I, or after the comparative development with ammonia, the following densities are measured:

| Sample | Developing Time (minutes) 1 | 3 | $NH_3$ |
|---|---|---|---|
| A | 2.05 | 2.10 | 1.80 |
| B | 1.95 | 2.00 | 1.75 |
| C | 1.30 | 1.90 | 1.80 |

For wet development the final density exceeds the density obtained with ammonia development; developing speed is clearly slower for C.

It will be obvious to those skilled in the art that many modifications may be made within the scope of the present invention without departing from the spirit thereof, and the invention includes all such modifications.

What is claimed is:

1. In a two-component diazotype material comprising a film support and a light-sensitive layer thereon, the light-sensitive layer being composed of at least one polymeric hydrophobic binder, a light-sensitive diazonium salt, and a coupler for the diazonium salt, the improvement that the light-sensitive layer additionally contains at least one resin, containing acid groups, which resin has an acid number of at least about 100, is derived from the maleic acid or phthalic acid type, and is present in a concentration of about 5 to 30 percent by weight, relative to the hydrophobic binder used.

2. A material in accordance with claim 1, in which the resin containing acid groups has an acid number of at least 200.

3. A material in accordance with claim 1, in which the resin containing acid groups is a copolymer of maleic anhydride with styrene, ethylene or an alkyl vinyl ether.

4. A material in accordance with claim 1, in which the resin containing acid groups is an acid alkyd resin based on phthalic anhydride.

5. A material in accordance with claim 1, in which a cellulose ester is used as a hydrophobic binder and a copolymer of maleic anhydride is used as a resin containing acid groups.

* * * * *